US009726434B2

(12) United States Patent
Steinbauer et al.

(10) Patent No.: US 9,726,434 B2
(45) Date of Patent: Aug. 8, 2017

(54) HEAT EXCHANGER WITH ADDITIONAL LIQUID CONTROL IN SHELL SPACE

(75) Inventors: Manfred Steinbauer, Raisting (DE); Christiane Kerber, Pocking (DE); Markus Hammerdinger, Tacherting (DE); Rainer Fluggen, Bichl (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 972 days.

(21) Appl. No.: 13/446,385

(22) Filed: Apr. 13, 2012

(65) Prior Publication Data

US 2012/0261089 A1 Oct. 18, 2012

(30) Foreign Application Priority Data

Apr. 14, 2011 (DE) ..... 10 2011 017 029

(51) Int. Cl.
*F28D 7/02* (2006.01)
*F28D 7/00* (2006.01)
(Continued)

(52) U.S. Cl.
CPC ..... *F28D 7/024* (2013.01); *F25J 5/002* (2013.01); *F28D 7/0066* (2013.01);
(Continued)

(58) Field of Classification Search
CPC ..... F25J 5/002; F25J 2290/32; F25J 2290/60; F28D 3/02; F28D 3/04; F28D 7/0066;
(Continued)

(56) References Cited

U.S. PATENT DOCUMENTS 3,158,010 A 11/1964 Kuerston
3,609,943 A 10/1971 Richter
(Continued)

FOREIGN PATENT DOCUMENTS

CH 517503 A 1/1972
CN 101600918 12/2009
(Continued)

OTHER PUBLICATIONS

Machine Translation of DE102007021565, retrieved Feb. 5, 2015.*
(Continued)

*Primary Examiner* — Len Tran
*Assistant Examiner* — Hans Weiland
(74) *Attorney, Agent, or Firm* — Millen, White, Zelano, Branigan, P.C.

(57) ABSTRACT

The invention relates to a heat exchanger (1) for indirect heat exchange comprising a tube bundle (10), formed from a plurality of tubes helically coiled around a core tube (100), for receiving a first medium, a shell (20). which encloses the tube bundle (10) and defines a shell space (200) surrounding the tube bundle (10), for receiving a second medium, and a liquid distributor (40) for distributing in the shell space (200) a stream (S), conveyed in the shell space (200), of the second medium in the form of a liquid (F). According to the invention a control device (33) for controlling distribution in the shell space (200) of an additional, further stream (S') of liquid (F), and/or for controlling distribution of stream (S) of liquid (F) in the shell space (200).

21 Claims, 3 Drawing Sheets

(51) Int. Cl.

| | |
|---|---|
| ***F28F 9/02*** | (2006.01) |
| ***F28F 27/02*** | (2006.01) |
| ***F25J 5/00*** | (2006.01) |
| *F28D 21/00* | (2006.01) |

(52) U.S. Cl.
CPC ..... *F28F 9/0265* (2013.01); *F28F 27/02* (2013.01); *F25J 2290/32* (2013.01); *F28D 2021/0066* (2013.01)

(58) Field of Classification Search
CPC F28D 7/024; F28D 2021/0066; F28F 9/0265; F28F 27/02; F28F 25/02; F28F 25/04; F28F 25/06; F28F 25/085; F28F 25/087; F25B 39/028
USPC ..... 165/115, 117, 118, 159, 163, 299, 300; 159/13.2, 13.3, 43.1
See application file for complete search history.

(56) References Cited

U.S. PATENT DOCUMENTS

| | | | | |
|---|---|---|---|---|
| 3,693,707 | A | 9/1972 | Richter | |
| 4,223,722 | A * | 9/1980 | Shade, Jr. | 165/111 |
| 5,472,044 | A * | 12/1995 | Hall et al. | 165/115 |
| 5,561,987 | A | 10/1996 | Hartfield et al. | |
| 5,588,596 | A * | 12/1996 | Hartfield et al. | 165/117 |
| 6,272,882 | B1 | 8/2001 | Hodges et al. | |
| 7,421,855 | B2 | 9/2008 | Ring | |
| 8,087,454 | B2 | 1/2012 | Kerber et al. | |
| 8,302,426 | B2 | 11/2012 | de Larminat | |
| 8,568,022 | B2 | 10/2013 | Saarinen | |
| 8,863,551 | B2 | 10/2014 | de Larminat | |
| 2008/0115918 | A1* | 5/2008 | Kerber et al. | 165/165 |
| 2008/0196839 | A1* | 8/2008 | Porscha et al. | 159/13.2 |
| 2010/0242533 | A1* | 9/2010 | De Larminat | F25B 39/028 62/498 |
| 2010/0326108 | A1* | 12/2010 | Schreiber | F25B 39/028 62/218 |

FOREIGN PATENT DOCUMENTS

| | | | |
|---|---|---|---|
| CN | 101855502 | | 10/2010 |
| CN | 101939626 | | 1/2011 |
| DE | 2237241 | A1 | 2/1974 |
| DE | 2835334 | A1 | 2/1980 |
| DE | 10 2004 040 974 | A1 | 3/2006 |
| DE | 102007021565 | A1 | 11/2008 |

OTHER PUBLICATIONS

Wilfried Bach "Offshore Liquefaction of Natural Gas With Liqui9d Nitrogen—Process Design and Comparison of Spiral-tube and Plate-fin Heat Exchangers—" Reports from Engineering and Science, [1990], 9 pages.

European Search Report from corresponding EP Application No. 12002468.2 dated Mar. 27, 2013.

Search Report for China Application 20120157115.2 (Apr. 12, 2012) Issued Mar. 4, 2015 (English translation).

* cited by examiner

HEAT EXCHANGER WITH ADDITIONAL LIQUID CONTROL IN SHELL SPACE

SUMMARY OF THE INVENTION

The invention relates to heat exchangers for the indirect heat exchange between at least one first and one second medium. Such heat exchanger can, for example, include: a tube bundle formed from a plurality of tubes, helically coiled around a core pipe, for receiving the first medium, a shell (or jacket), enclosing the tube bundle and defining a shell space (or jacket space) surrounding the tube bundle, for the reception of the second medium, and a liquid distributor for distributing a stream (S) of the second medium in the form of a liquid (F) in the shell space (200), Such a heat exchanger permits the indirect heat exchange between a first and a second medium and comprises at least one tube bundle for receiving the first medium, a shell enclosing the at least one tube bundle, which shell defines a shell space surrounding the tube bundle for receiving the second medium in the form of a liquid, and a liquid distributor, which is designed to distribute a stream (main stream) of the second medium over a cross-section of the shell space. The tube bundle is preferably formed from a plurality of tubes, which are helically coiled around a core tube which extends along the longitudinal axis (cylinder axis) of the shell in the shell space.

Such a heat exchanger is known from DE 10 2004 040 974 A1.

In heat exchangers that operate by falling film evaporation, i.e. the liquid to be evaporated flows down from the top through the evaporation space (shell space) and is partially evaporated in the process, heat transfer between shell side (shell space) and tube side (tube bundle) is based on a steady heat quantity supply from both sides. On the tube side the streams are distributed uniformly to all layers. However, this uniform distribution may be impaired by external conditions, for example by gas entrainment in an otherwise purely liquid stream. On the shell side the liquid distributor systems are designed such that a two-phase liquid/gas mixture (second medium) is calmed and degassed in a predistributor system. The degassed liquid is then accumulated via a downcomer to generate pressure and supplied to the actual main distributor system. The liquid is braked by a fixedly installed flow retarder in the lower part of the downcomer and degassed further. The main distributor system is load-independent and static, whereby changes arising in the overall system (e.g. gas content, load) may have an effect on distribution quality.

Taking this as a basis, the problem underlying the present invention is that of improving a heat exchanger of the above-mentioned type with regard to the distribution quality.

Thus, an aspect of this invention is therefore to provide a heat exchanger system of the above-mentioned type with improved distribution quality.

Upon further study of the specification and appended claims, other aspects and advantages of the invention will become apparent.

This problem is solved by a heat exchanger having a control means for controlling distribution in the shell space of an additional, further stream, conveyed in the shell space, of the liquid, and/or to control distribution of the stream of the liquid in the shell space.

According thereto, a control means is provided, which is designed to control distribution in the shell space of an additional, further stream (sub-stream), conveyed in the shell space parallel to the stream (main stream), of the liquid, and/or to control distribution of the stream (main stream) of the liquid in the shell space.

According to the invention, the quantity of heat supplied is thus influenced in particular on the shell side (and optionally on the tube side, see below), in order to thus be able to respond to the respectively prevailing conditions. To this end, distribution and feed of a part of the liquid (further stream) is conducted parallel to the (main) stream in particular on the shell side. In this way, liquid distribution may be purposefully adapted from outside to the conditions prevailing in the heat exchanger.

Through separate shell-side control of the sub-stream or further stream of the liquid, it is possible purposefully to counteract maldistribution and/or discontinuities, which may be detected by temperature measurements. Such maldistribution or discontinuities may be brought about by conditions external to the heat exchanger or result from thermodynamic processes within the tube bundle of the heat exchanger. As a result of the controlled shell-side liquid distribution, the heating surface of the heat exchanger may be put to optimum use and performance kept higher, even under unfavorable conditions, than without the above-stated control.

To distribute the liquid to be distributed of the (main) stream, the liquid distributor comprises a main distributor above the tube bundle, which is provided with passage openings (perforated plate) through which the liquid may rain down onto the tube bundle.

There is preferably provided at least one additional line controllable with the control means and having at least one outlet arranged above the tube bundle, via which outlet the further stream of the liquid may be fed controllably onto the tube bundle. In this case, to control distribution of the further stream of the liquid to the tube bundle, the control means comprises at least one valve of the additional line, with which for example the effective cross-section of that line may be varied.

Furthermore, the main distributor comprises at least one passage region, through which tubes of the tube bundle may pass, wherein the passage region is defined in particular by two distributor arms of the main distributor, via which the liquid may be fed onto the tube bundle. The at least one line is preferably also passed through this passage region, in order to be able to distribute the further stream (sub-stream) predefinably to the tube bundle arranged below the main distributor.

Of course, to convey the further stream or further streams it is also possible to provide a plurality of lines each with at least one outlet, via which liquid may additionally be fed controllably onto the tube bundle. The outlets are preferably distributed in such a way over the cross-section (oriented perpendicular to the longitudinal axis of the shell) of the shell space that the further stream of the liquid is variably distributable in a radial direction of the shell at least to two (or indeed a plurality of) sections of the tube bundle and/or in a circumferential direction of the shell, i.e. distribution of the further stream to the sections may be separately controlled for each section.

To distribute the stream (main stream) of the liquid the main distributor preferably comprises a plurality of distributor arms, which in particular each extend in the radial direction of the shell. In this case, the distributor arms in particular each exhibit a pie-slice shape, i.e. take the form of a sector of a circle (the base of the distributor arm being in the shape of a truncated triangle). The passage regions are then preferably shaped accordingly.

To supply the main distributor with the stream (main stream) of the liquid to be distributed, the liquid distributor comprises at least one downcomer, which is preferably arranged in the core tube of the tube bundle and in particular comprises an external diameter which is smaller than the internal diameter of the core tube. The main distributor is in this case connected via the at least one downcomer to a predistributor (preliminary distributor) of the liquid distributor, which serves to collect and calm the liquid.

In a variant of the invention, the distributor arms are subdivided for variable (controllable) distribution of the stream (main stream) of the liquid in the radial direction into at least two separate (or a plurality of) segments, which each comprise at least one passage opening through which liquid may rain onto the tube bundle. The control means is set up and provides control of a feed of liquid into the two (or plurality of) segments separately for each segment, such that the liquid is variably distributable in the radial direction of the shell onto at least two (or accordingly a plurality of) sections of the tube bundle. To this end downcomers (e.g. with valves) may be associated with the individual segments, via which downcomers the segments may be controllably charged with liquid from the stream (main stream), such that distribution of the liquid to the two sections (or indeed plurality of sections) is separately controllable for each section.

In a further exemplary embodiment provision is made for at least two (or a plurality of) distributor arms to be designed to supply liquid to in each case different sections of the tube bundle in the radial direction of the shell. In the process, the distributor arms each comprise at least one passage opening for distributing the liquid of the stream (main stream) to the sections, through which passage opening liquid may be fed onto the tube bundle, wherein the passage openings are differently positioned in the radial direction, such that sections of the tube bundle may be selectively (controllably) supplied with liquid by the distributor arms. To charge the distributor arms with the liquid to be distributed, a plurality of downcomers are preferably provided, wherein each downcomer supplies at least one, in particular two distributor arms with liquid. In this respect, the downcomers are in particular arranged in the core tube or are formed by subdivision of the core tube into sections. Control of the liquid feed through the downcomers (e.g. by means of valves) may likewise control distribution of the stream (main stream) of the liquid to the sections of the tube bundle separately for each section.

Control may also be performed on the tube-side, the tube-side control cooperating with the shell-side control in that the tubes of the tube bundle or tube space are helically coiled around the core tube so as to form at least the above-stated first and second sections of the tube bundle (or indeed a plurality of sections). In this case, the sections are formed separately from one another and each surround the core tube, wherein the second section encircles the first section of the tube bundle, i.e. the sections subdivide the tube bundle in the radial direction of the shell, whose longitudinal axis or cylinder axis coincides with the longitudinal axis (cylinder axis) of the core tube. More than two sections, e.g. three sections, can be present.

The first and the second section penetrate each other when the two hollow cylinders, formed by the sections, overlap each other at least partially. In such a case, the radially innermost section extends away from the core pipe up to a given radius R1. The second section extends from the core tube from a radius R2 up to a radius R3. If the second section surrounds the first section, the radius R2 is at least as large as the radius R1. If the second section penetrates the first section, the radius R2 is smaller than R1. The two hollow cylinders, which are formed by the sections, consequently overlap at least partially. Within the framework of the invention, it is also possible for the two sections to overlap in a complete manner.

In accordance with further embodiments of the invention, 3 or more sections may also be advantageous, in which the individual sections surround or penetrate each other. In an analogous manner to the preceding, it is advantageous when a third section surrounds a second section, which, in its turn, surrounds a first section. It is also advantageous in an alternative embodiment when a third section penetrates a second section, which penetrates a first section. Combinations of sections being surrounded with sections being penetrated just as more than 3 sections are also alternative expedient developments of the invention.

The separate (hollow-cylindrical) sections each further comprise at least one associated inlet, such that they may each be separately charged with the first medium. In this respect, a further control means may be provided, with which feed of the first medium via the respective inlet of a section may be controlled separately from feed of the first medium via the inlets of the other sections (e.g. by means of valves associated with the inlets). The individual sections each further comprise at least one associated outlet for outlet of the first medium from the tube space or shell.

In a preferred manner the flow through the tubes and/or the flow at the shell side are controlled depending on the measured temperature at one or more points of the heat exchanger. Advantageously the heat exchanger comprises at least one optical fiber connected to equipment suitable for determining a temperature from the signals of the optical fiber. The use of an optical fiber provides the opportunity to determine the temperature at any point or various given points of the optical fiber by the analysis of optical signals originating of Raman scattering, Brillioun scattering or of the scattering of a Bragg grating. All these signals are temperature depending and therefore suitable for the determination of the temperature. The optical fibers are preferably fastened on or inside the tubes.

BRIEF DESCRIPTION OF THE DRAWINGS

Further features and advantages of the invention are to be explained with the following description of the Figures of exemplary embodiments by way of the Figures, in which:

FIG. 1 shows a heat exchanger 1 comprising an, in particular hollow cylindrical, pressure-bearing shell 20 (not shown in FIG. 1), whose longitudinal or cylinder axis extends in vertical direction Z, relative to a heat exchanger 1 in the properly arranged state. The shell 20 defines a shell space 200, in which a helically coiled tube bundle 10 is arranged. This comprises a plurality of tubes, which are helically coiled in a plurality of layers around a core tube 100, whose longitudinal axis coincides with the longitudinal axis of the shell 20. The tube bundle 10 is thus arranged coaxially relative to the shell 20.

Figure 1:
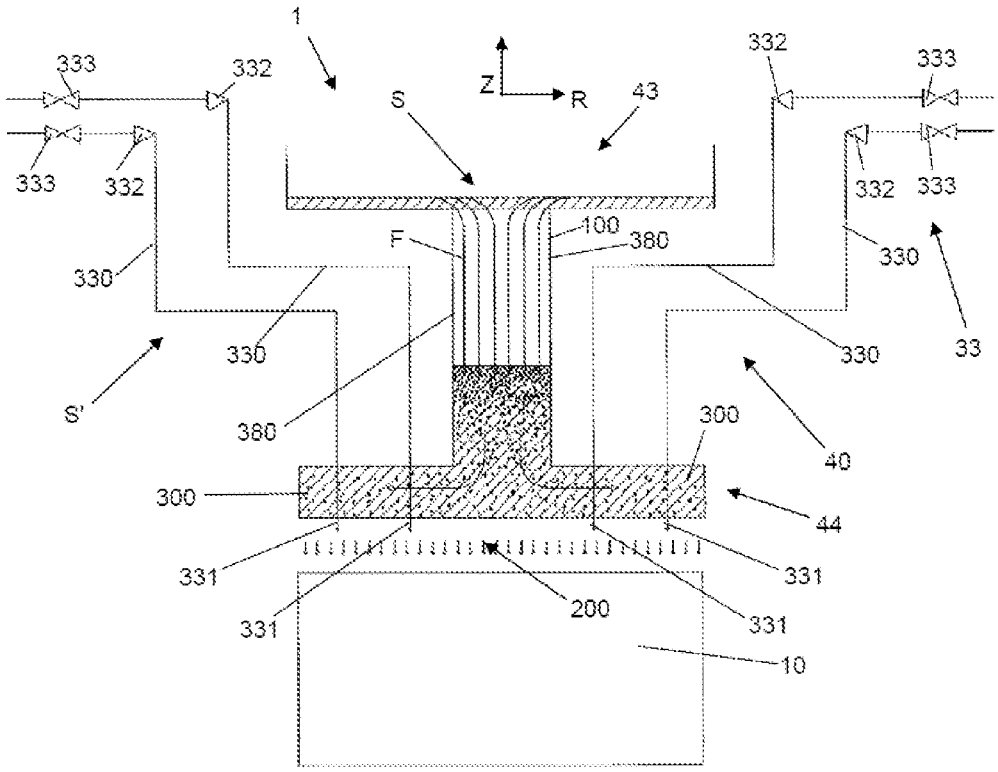
FIG. 1 is a partial, schematic sectional view of a heat exchanger with a controllable sub-stream of a liquid to be distributed.

At least one first medium is fed into the tube space (tube bundle 10) and flows upwards in the vertical direction Z. The shell space 200 serves to accommodate a second medium in the form of a liquid F, which is fed onto the at least one tube bundle 10 and flows downwards in the vertical direction Z in the shell space. Because the tube bundle 10 takes the form of a helically coiled tube bundle, the first medium is thus conveyed in cross-countercurrent relative to liquid F.

To distribute the liquid F in the shell space 200, a stream S of the liquid F introduced into the shell 20 is collected, calmed and degassed in a predistributor 43. To accommodate the liquid F, the predistributor 43 here comprises a peripheral wall, which extends upward from a base, the base extending transversely to the longitudinal axis of the shell 20. The base predistributor 43 is connected via a downcomer 380 extending into the core tube 100 to a main distributor 44, and supplies the latter with the stream S of the liquid F. Main distributor 44 comprises a plurality of distributor arms 300 (cf. FIG. 2) for distributing the stream S of the liquid F over the entire cross-section of the shell space 200 transversely to the vertical direction Z. In each case, the distributor arms extend from the core tube 100 in the form of sectors of a circle in a radial direction R of the shell 20, such that between the distributor arms 300 passage regions 45 are formed (cf. FIG. 2), through which the tubes of the tube bundle 10 may bypass the main distributor 44.

The distributor arms 300 each comprise a base with a plurality of passage openings ("perforated plates"), through which liquid F introduced into the distributor arms 300 may rain onto the tube bundle 10 arranged therebelow in the vertical direction Z.

To be able to influence distribution of the liquid F in the shell space and optionally, for example, counteract uneven distribution, distribution and feed of a part of the liquid F then proceeds on the shell side in the form of at least one further stream S' parallel to the (main) stream S.

To this end, additional lines 330 are provided for conveying the further stream S' (or the further streams). The further stream S' is introduced into the additional lines 330 and shell space 200 via corresponding inlets/ports 332. The additional lines 330 in each case have at least one outlet 331, via which the liquid F may be fed with additional control onto the at least one tube bundle 10. The lines 330 therefore each have a valve 333. To be able to feed the liquid F in a controlled manner via the additional lines 330 onto the tube bundle 10, the additional lines 330 pass through the passage regions 45 of the main distributor 44 and the outlets 331 thereof are arranged above the tube bundle 10, in particular such that the tube bundle 10 may be supplied with the liquid F in the radial direction R of the shell 20 in separately controllable sections. The sections of the shell in this case each surround the core tube 100 and are in this case of hollow (circular) cylindrical construction. The individual sections thus each engage around the sections which are radially further towards the inside.

Figure 2:
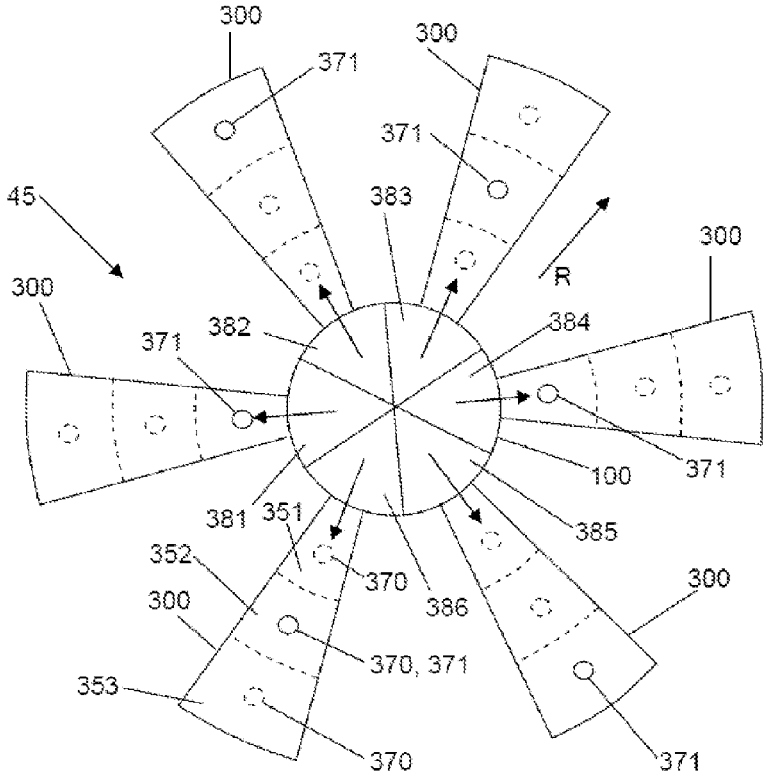
FIG. 2 is a schematic plan view of distributor arms of a liquid distributor of a heat exchanger for controlling distribution of a main stream of a liquid to be distributed.

FIG. 2 shows options for controlling the main stream S. Here, the distributor arms 300 of a main distributor 44 as in FIG. 1, are shaped like sectors of circles and are separated from one another by the passage regions 45. The distributor arms 300 may be subdivided for variable distribution of the stream S of the liquid F in the radial direction R into, for example, at least three separate segments 351, 352, 353, which each comprise at least one passage opening 370, through which the liquid F may rain down onto the tube bundle 10 located therebelow. If feed of the liquid F into the segments 351, 352, 353 is then separately controlled for each of the segments 351, 352, 353, for example in that each segment 351, 352, 353 is supplied (for example from a predistributor 43) via a downcomer controllable by means of a valve, the stream S of the liquid F may be variably distributed in the radial direction R of the shell 20 onto a number of sections of the tube bundle (see above) corresponding to the number of segments.

As an alternative, the distributor arms 300 may be designed to supply different sections of the tube bundle 10 with liquid F, for example by corresponding distribution of the passage holes 371 of the distributor arms 300 in the radial direction R according to FIG. 2. To illustrate this, the distributor arms 300 according to FIG. 2 each comprise a passage opening 371, which is displaced in the radial direction R relative to the corresponding passage openings 371 of the adjacent distributor arms 300. Other such distributions, in particular with a plurality of passage holes per distributor arm 300, are likewise conceivable. In order then to be able to charge the individual distributor arms 300 with liquid F from the (main) stream S, provision is preferably made for the core tube 100 to be subdivided into sections 381-386, such that a corresponding number of downcomers is formed, which are each preferably designed to be controllable (for example by means of valves) and each charge at least one associated distributor arm 300 with the liquid F (cf. FIG. 2). It is also feasible for a section 381-386 of the core tube 100 to supply more than one distributor arm 300 with liquid F, for example two distributor arms 300. The downcomers 381-386 may in turn be supplied, for example, from a predistributor 43 according to FIG. 1.

Figure 3:
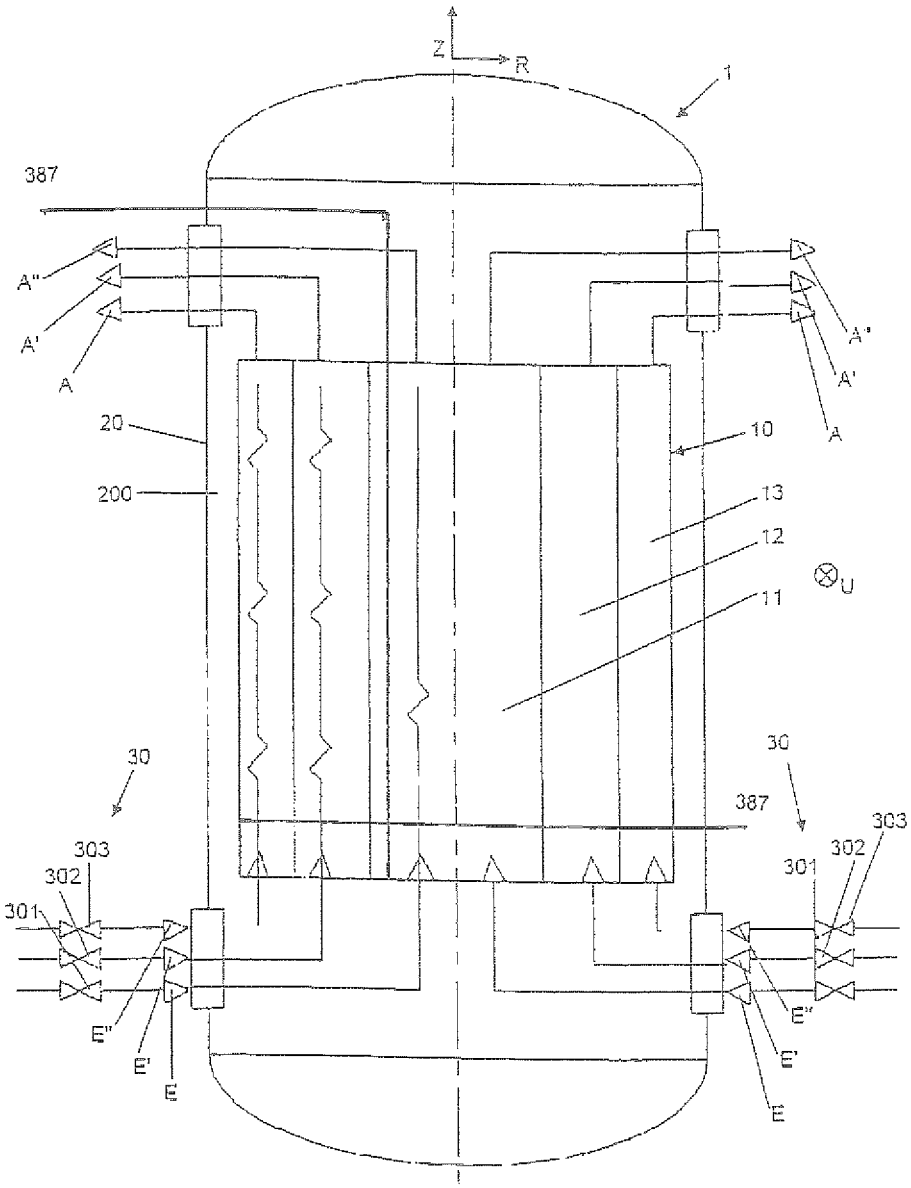
FIG. 3 is a further schematic sectional view of a heat exchanger with a tube bundle, which forms radial sections which may be separately (controllably) supplied.

FIG. 3 further shows, in a schematic sectional view, a heat exchanger 1 having the additional options of corresponding sectional subdivision and control of the tube streams. To this end, the tubes of the tube bundle 10, arranged coaxially relative to the shell 20 of the heat exchanger 1, are preferably helically coiled around the core tube 100 (not shown) so as to form in the present case, by way of example, first, second and third hollow-cylindrical sections 11, 12, 13 of the tube bundle 10. These sections are separate from one another and each surrounds the core tube 100. The second section 12 encircles the first section 11 of the tube bundle 10 and the third section 13 encircles the other two sections 11, 12. The liquid F may then rain down, as described above, on these sections 11, 12, 13 in a separately controllable manner. Furthermore, the three sections 11, 12, 13 can not only be charged with the first medium separately via at least one associated inlet E, E', E" at a bottom end of the shell 20, but additionally supply of the tube side may be controlled via valves 301, 302, 303, associated with the inlets E, E', E", of a further control means 30, which is in addition to the shell-side control. The medium introduced into sections 11, 12, 13 may finally be drawn off from the tube bundle 10 at a top end of the shell 20 via in each case at least one outlet A, A, A" per section.

Advantageously, one or more optical fibers 387 are fastened on the tubes (or within the tubes) of the tube bundle 10. The temperature of the tubes can be determined from the signals of the optical fibers.

The entire disclosure[s] of all applications, patents and publications, cited herein and of corresponding German Application No. 10 2011 017 029.4 filed Apr. 14, 2011, are incorporated by reference herein.

The preceding examples can be repeated with similar success by substituting the generically or specifically described reactants and/or operating conditions of this invention for those used in the preceding examples.

| List of reference signs | |
|---|---|
| 1 | Heat exchanger |
| 10 | Tube bundle |
| 11 | First section |
| 12 | Second section |
| 13 | Third section |
| 20 | Shell |
| 30 | Further control means |
| 33 | Control means |
| 40 | Liquid distributor |
| 43 | Predistributor |
| 44 | Main distributor |
| 45 | Passage region |
| 100 | Core tube |
| 200 | Shell space |
| 300 | Distributor arm |
| 301 | Valve |
| 302 | Valve |
| 303 | Valve |
| 330 | Line |
| 331 | Outlet |
| 332 | Inlet |
| 333 | Valve |
| 351 | Segment |
| 352 | Segment |
| 353 | Segment |
| 370 | Passage opening |
| 371 | Passage opening |
| 380 | Downcomer |
| 381-386 | Downcomer section |
| 387 | Optical fiber |
| A, A', A" | Outlet |
| E, E', E" | Inlet |
| S | Stream |
| S' | Further stream |
| R | Radial direction |
| Z | Vertical direction |
| U | Circumferential direction |

The invention claimed is:

1. A heat exchanger for indirect heat exchange between at least one first medium and one second medium, comprising:

a tube bundle (10), formed from a plurality of tubes helically coiled around a core tube (100), for receiving said first medium, a shell (20) enclosing said tube bundle (10), said shell defining a shell space (200) that surrounds said tube bundle (10), for receiving said second medium, and a liquid distributor (40) for distributing, in the shell space (200) a stream (S), conveyed into said shell space (200), of said second medium in the form of a liquid (F), wherein said liquid distributor (40) comprises a main distributor (44), above said tube bundle (10), for receiving the stream (S) of liquid (F) to be distributed, wherein said main distributor (44) comprises a plurality of distributor arms (300) and each of said distributor arms comprises passage openings through which liquid (F) may be fed onto said tube bundle (10)

a control means (33) to control distribution in said shell space (200) of an additional further stream (S'), conveyed in said shell space (200), of liquid (F), and at least one line (330) with at least one outlet, via which the further stream (S') of liquid (F) may be fed controllably onto said tube bundle (10), separately from the stream (S) of liquid (F) distributed by said liquid distributor (40), wherein said control means (33) comprises at least one valve (333) for said at least one line (330) for controlling distribution of the further stream (S') of liquid (F).

2. The heat exchanger according to claim 1, wherein said main distributor (44) comprises at least one passage region (45), through which tubes of said tube bundle (10) may be passed, wherein said passage region (45) is defined by two distributor arms (300) of said main distributor (44).

3. The heat exchanger according to claim 2, wherein said at least one line (330) is passed through said at least one passage region (45).

4. The heat exchanger according to claim 1, wherein said heat exchanger comprises a plurality of said lines (330), each having at least one outlet (331), via which the further stream (S') of liquid (F) can be fed controllably onto said tube bundle (10), wherein said outlets (331) of said lines (330) are distributed over a cross-section of said shell space (200) in such a way that the further stream (S') of liquid (F) can be:

(a) variably distributed, in a radial direction (R) of said shell (20), to at least a first and a second section (11, 12, 13) of said tube bundle (10), (b) variably distributed in a circumferential direction (U) of said shell (20), or (c) variably distributed, in a radial direction (R) of said shell (20), to at least a first and a second section (11, 12, 13) of said tube bundle (10), and variably distributed in a circumferential direction (U) of said shell (20).

5. The heat exchanger according to claim 1, wherein said main distributor (44) comprises a plurality of distributor arms (300), which in each case extend in a radial direction (R) of said shell (20).

6. The heat exchanger according to claim 5, wherein said distributor arms (300) are subdivided, for variable distribution of the stream (S) of liquid (F) in the radial direction (R), into at least two separate segments (351, 352, 353), wherein each of said segments comprises at least one passage opening (370) through which liquid (F) may be fed onto said tube bundle (10), and said control means (33) controls a feed of liquid (F) separately into said at least two segments (351, 352, 353), such that liquid (F) van be variably distributed in the radial direction (R) of said shell (20) onto at least one first and one second section (11, 12, 13) of said tube bundle (10).

7. The heat exchanger according to claim 5, wherein at least one of said distributor arms (300) is adapted to supply liquid (F) in the radial direction (R) of said shell (20) to a first section (11) of said tube bundle and at least one other of said distributor arms (300) is adapted to supply liquid (F) in the radial direction (R) of said shell (20) to a different, second section (12) of said tube bundle, wherein these at least two distributor arms (300) each comprise at least one passage opening (371) for distributing liquid (F) to said first and second sections (11, 12) of said tube bundle, through which passage opening liquid (F) may be fed onto said tube bundle (10), wherein said passage openings (371) are differently positioned in the radial direction (R), and wherein a plurality of downcomers (381-386) is provided to supply the distributor arms (300) with the liquid (F), wherein each downcomer (381-386) can supply at least one distributor arm (300) with liquid (F), and wherein said downcomers (381-386) are arranged in said core tube (100) or are formed by subdivision of said core tube (100) into sections (381-386).

8. The heat exchanger according to claim 7, wherein said tubes of the tube bundle (10) are helically coiled around said core tube (100) so as to form at least said first and second sections (11, 12, 13) of said tube bundle (10), wherein said first and second sections (11, 12, 13) of said tube bundle (10) are formed separately from one another and each surround said core tube (100), wherein said second section (12) surrounds said first section (11) of said tube bundle (10), and wherein said first and second sections (11, 12) each comprise at least one associated inlet (E, E'), by which said first and second sections (11, 12) may be separately charged with the first medium.

9. The heat exchanger according to claim 8, wherein a further control means (30) is provided, with which feed of the first medium into said first section (11) of said tube bundle (10) via the inlet (E) of said first section (11) may be controlled separately from feed of the first medium into said second section (12) of said tube bundle (10) via the inlet (E') of said second section (12).

10. The heat exchanger according to claim 9, wherein said further control means (30) comprises at least one valve (301) for the inlet (E) of said first section (11) and one valve (332) for the inlet (E') of said second section (12).

11. The heat exchanger according to claim 8, wherein said first and second sections (11, 12) each comprise at least one associated outlet (A, A') for outlet of the first medium.

12. The heat exchanger according to claim 8, wherein said tubes are helically coiled in such a way around said core tube (100) that a further, third circumferential section (13) of the tube bundle (10) is formed, which surrounds the second section (12), wherein said third section (13) comprises at least one associated inlet (E"), by which said third section (13) may be charged with the first medium separately from the said first and second sections (11, 12), and wherein control means (30) controls feed of the first medium into said third section (13) of said tube bundle (10), via the inlet (E") of said third section (13), separately from feed of the first medium via the inlets (E, E') of said first and second sections, and wherein control means (30) comprises at least one valve (303) for the inlet (E") of said third section (13), and wherein said third section (13) comprises at least one associated outlet (A") for outlet of the first medium from said third section (13) of said tube bundle (10).

13. The heat exchanger according to claim 1, wherein said heat exchanger further comprises at least one optical fiber connected to equipment for determining a temperature from signals of said at least one optical fiber.

14. The heat exchanger according to claim 1, wherein said control means (33) also controls distribution of the stream (S) of liquid (F) in said shell space (200).

15. The heat exchanger according to claim 1, wherein said heat exchanger comprises a plurality of said lines (330), each having at least one outlet (331), via which the further stream (S') of liquid (F) can be fed controllably onto said tube bundle (10), wherein said outlets (331) of said lines (330) are distributed over a cross-section of said shell space (200) in such a way that the further stream (S') of liquid (F) can be variably distributed, in a radial direction (R) of said shell (20), to at least a first and a second section (11, 12, 13) of said tube bundle (10).

16. The heat exchanger according to claim 1, wherein said heat exchanger comprises a plurality of said lines (330), each having at least one outlet (331), via which the further stream (S') of liquid (F) can be fed controllably onto said tube bundle (10), wherein said outlets (331) of said lines (330) are distributed over a cross-section of said shell space (200) in such a way that the further stream (S') of liquid (F) can be variably distributed in a circumferential direction (U) of said shell (20).

17. The heat exchanger according to claim 1, wherein said plurality of distributor arms (300) extend outward from said core pipe (100) in a radial direction (R) of the shell (20), and said main distributor (44) has a plurality of passage regions (45) wherein adjacent distributor arms (300) are separated from each other by a passage regions (45), said distributor arms (300) receiving said stream (S) of liquid (F), and said distributor arms (300), in each case, having a plate with a plurality of passage openings (370, 371) through which liquid (F) introduced into the distributor arms (300) can rain onto said tube bundle (10) arranged below said main distributor (44), and said liquid distributor (40) having a plurality of downcomers (381-386) which are formed by dividing said core pipe (100) into sections, wherein each of said downcomers (381-386) supplies at least one of said distributor arms with liquid (F).

18. The heat exchanger according to claim 17, wherein said distributor arms (300) are divided into a plurality of segments (351-353), and wherein said passage openings (371) are distributed along the radial direction of said distributor arms (300), and said passage openings (371) in each distributor arm (300) are displaced in the radial direction with respect to corresponding passage openings (371) of an adjacent distributor arms (300).

19. The heat exchanger according to claim 17, wherein said heat exchanger comprises a plurality of said lines (330) via which the additional further stream (S') of liquid (F) in said shell space (200) can be delivered in a controllable manner onto the tube bundle (10), each of said lines (330) having at least one outlet (331) and at least one valve (332), wherein said lines (330) are guided through the passage regions (45) of the main distributor (44) and the outlets (331) of said additional lines (330) are arranged above the tube bundle (10), and wherein the outlets (331) of said lines (330) are distributed over a cross section of the shell space (200) such that the further flow (S') of liquid (F) can be variably distributed in a radial direction (R) of said shell (20).

20. The heat exchanger according to claim 18, wherein said heat exchanger comprises a plurality of said lines (330) via which the additional further stream (S') of liquid (F) in said shell space (200) can be delivered in a controllable manner onto the tube bundle (10), each of said lines (330) having at least one outlet (331) and at least one valve (332), wherein said lines (330) are guided through the passage regions (45) of the main distributor (44) and the outlets (331) of said additional lines (330) are arranged above the tube bundle (10), and wherein the outlets (331) of said lines (330) are distributed over a cross section of the shell space (200) such that the further flow (S') of liquid (F) can be variably distributed in a radial direction (R) of said shell (20).

21. The heat exchanger according to claim 17, wherein each of said downcomers (381-386) supplies two of said distributor arms with liquid (F).

* * * * *